United States Patent [19]

McGee et al.

[11] 4,071,456

[45] Jan. 31, 1978

[54] FABRIC-SOFTENING COMPOSITIONS

[75] Inventors: Thomas McGee; David William Roberts, both of Wirral, England

[73] Assignee: Lever Brothers Company, New York, N.Y.

[21] Appl. No.: 516,943

[22] Filed: Nov. 6, 1974

[30] Foreign Application Priority Data

Oct. 23, 1973 United Kingdom ..... 49295/73

[51] Int. Cl.[2] ..... D06M 7/02; D06M 13/30; D06M 13/32

[52] U.S. Cl. ..... 252/8.7; 252/8.6

[58] Field of Search ..... 260/327 S; 252/8.7, 252/8.6

[56] References Cited

U.S. PATENT DOCUMENTS

| | | | |
|---|---|---|---|
| 2,061,618 | 11/1936 | Downing et al. | 260/513 R |
| 3,164,608 | 1/1965 | Blaser | 260/327 S |
| 3,357,992 | 12/1967 | Hierdnymus et al. | 260/327 S |
| 3,409,637 | 11/1968 | Eccles et al. | 260/327 S |
| 3,422,021 | 1/1969 | Roy | 252/161 |
| 3,424,693 | 1/1969 | Stein et al. | 260/327 S X |
| 3,424,694 | 1/1969 | Stein et al. | 260/327 S X |
| 3,579,537 | 5/1971 | Rubinfeld et al. | 252/327 S |
| 3,755,429 | 8/1973 | Smitherman et al. | 260/513 R |
| 3,787,441 | 1/1974 | Kennedy et al. | 260/327 S |

FOREIGN PATENT DOCUMENTS

| | | |
|---|---|---|
| 894,830 | 3/1972 | Canada. |
| 1,030,648 | 5/1966 | United Kingdom. |

OTHER PUBLICATIONS

U. Einsele, Melliand Textilber, 41, pp. 721–729 (1960), (Chem. Abs. 54, 18967 g).

Textile Res. J. 42, No. 2, 119–122 (Feb. 1972).

*Primary Examiner*—Allan Lieberman

*Attorney, Agent, or Firm*—James J. Farrell; Kenneth F. Dusyn; Melvin H. Kurtz

[57] ABSTRACT

A fabric-softening composition comprises a dispersing agent, in particular a detergent-active compound, and a sultone of from 14 to 30 carbon atoms of the structure

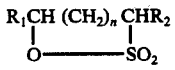

in which each of $R_1$ and $R_2$ is H or an aliphatic hydrocarbon radical having a chain of from 1 to 27 carbon atoms, at least one of $R_1$ and $R_2$ has a chain of at least 10 carbon atoms, and n is 1 or 2. Fabrics are softened by treatment with such a composition in the form of a dilute aqueous dispersion.

10 Claims, No Drawings

FABRIC-SOFTENING COMPOSITIONS

This invention relates to fabric-softening compositions, to processes for the treatment of multiple fibre materials and to treated fabrics.

In a process of washing fibrous materials such as fabrics or hair with detergent compositions, the soil present on the fibre surface is removed from the fibres into the wash solution, often leaving them with a harsh feel. Conditioners or softening agents can be used to impart a soft feel by facilitating movement of the fibres in contact with one another. Such conditioners or softening agents are usually employed in a rinse subsequent to the washing, and are in practice cationic compounds which cannot be employed in the washing process together with anionic detergents without some loss of efficiency because of the formation of complexes. The problem of providing softening agents which can be used in the washing process is difficult because any additive to a wash which is to provide the desired softening effect has to be deposited on the fibres in opposition of the action of the detergent which is removing soil from the fibres.

Sodium higher fatty acid sulphonates can be used in anionic detergent washes to provide valuable softening properties, but relatively high concentrations of them are necessary if a good result is to be obtained. These substances are believed to act by conversion to calcium salts with calcium ions present in the wash system.

It has now been discovered that certain long-chain aliphatic sultones (which are internal esters of hydroxyalkyl sulphonic acids) have a capacity to soften fibres that is retained in detergent solutions, and that they can be used in the washing process in relatively small quantities. Because such sultones are compatible with anionic detergents, this enables the formulation of anionic detergent-active based compositions that confer softening properties on the fibres during the washing process, and are without the disadvantages of cationic compounds.

Sultones which have these properties include compounds that are formed as by-products in the sulphonation of alpha-olefins with sulphur trioxide during the preparation of olefin sulphonate detergents. Since sultones have no detergent properties, steps have always hitherto been taken to eliminate them before the products are formulated as detergent compositions. Thus U.S. Pat. No. 2,061,618 which was published in 1936 discloses a process in which alpha-olefins are sulphonated with various reagents such as sulphur trioxide and chlorsulphonic acid in order to give sulphonation mixtures which are then subjected to hydrolysis to obtain detergent-active materials. Although nothing is stated about the presence of sultones, later publications, for instance British Pat. No. 1,030,648, indicate that gamma-sultones form a substantial part of the direct products of sulphonation and that most of the gamma-sultones are eliminated in the subsequent hydrolysis and other operations, so that any sultone present in the final product used for detergent formulation is insubstantial relative to the detergent-active present.

The disclosure of U.S. Pat. No. 2,061,618 also states that products of some value as emulsifying agents may be obtained by reacting unsaturated hydrocarbons with strong sulphonating agents and then merely neutralising the reaction mass without hydrolysing it. It is stated that these intermediate products may also possess some wetting and detergent power, particularly if relatively short chain unsaturated hydrocarbons are employed. It is furthermore stated that in general, however, these products are insoluble or only slightly soluble in water, depending largely on the sulphonating agent employed. This is a warning for anyone concerned with the production of detergents that where the immediate products of reaction are from long chain olefins they are insoluble and of no value as detergents without a further hydrolysis.

British Pat. No. 1,030,648 discloses that the sulphonation of $C_{12}$ to $C_{20}$ olefins with gaseous sulphur trioxide gives direct sulphonation products containing high proportions of gamma sultones together with small amounts of delta-sultones, and instructs either the separation of the sultones from the sulphonates by solvent extraction or the hydrolysis and neutralisation of these immediate reaction products, followed by recovery of the sulphonate content. A small amount of delta-sultone remains in the hydrolysed products and can be removed by de-oiling. The products are formulated as detergents, for instance by adding detergency builders. The separation process also provides a method of preparing n-alkyl gamma-sultones.

U.S. Pat. No. 3,428,654 describes sulphonation processes which produce mixtures of gamma-sultones and olefin sulphonic acids, which are then subjected to treatment with concentrated sulphuric acid in order to isomerise the gamma-sultones to delta-sultones and to sulphate unconverted olefin: subsequently the mixtures are hydrolysed with strong alkali, by which the delta-sultones are converted to olefin sulphonate rather than the hydroxy sulphonates which are formed from gamma-sultones and are relatively inactive as detergents.

The history of the preparation of olefin sulphonate detergents is thus one of eliminating or minimising the insoluble sultone by-products because these do not themselves have detergent properties. In contrast with this the discovery of the valuable softening products of sultones in formulated detergent compositions calls for an increase in the relative proportion of sultone to olefin sulphonate in an olefin sulphonate detergent when this is formulated with a detergency builder.

According to the present invention, a fabric softening composition comprises a dispersing agent and a sultone of from 14 to 30 carbon atoms of the structure

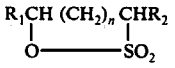

in which each of $R_1$ and $R_2$ is H or an aliphatic hydrocarbon radical having a chain of from 1 to 27 carbon atoms, at least one of $R_1$ and $R_2$ has a chain of at least 10 carbon atoms, and $n$ is 1 or 2; with the proviso that where the dispersing agent comprises an olefin sulphonate, at least 0.2 parts of the sultone to 1 part of the olefin sulphonate by weight and a detergency builder are present.

The sultone is preferably one where $R_2$ is hydrogen. In practice the $R_1$ and $R_2$ aliphatic hydrocarbon radicals are acyclic, and preferably without any chain branching. Preferably also the aliphatic hydrocarbon radicals are saturated. It has been found that sultones having an unbranched saturated hydrocarbon chain of from 16 to 22 carbon atoms are preferable and that of these sultones with from 18 to 20 carbon atoms are the most suitable. Such sultones where $R_2$ is hydrogen are of particular interest because they can readily be obtained during the process of sulphonation of alpha-olefins simultaneously with olefin sulphonates that have excellent detergent properties. Examples of suitable sultones are both the gamma and delta isomers of n-tetradecane, n-hexadecane, n-octadecane, n-eicosane, n-docosane, n-tetracosane, 1-methylpentadecane, 1-methylheptadecane, 1-methylnonadecane, and 1-ethylhexadecane sultones. Mixtures of the gamma and delta isomers or mixtures of sultones of different total numbers of carbon atoms such as those derived from mixtures of alpha-olefins, or mixtures of sultones having different groups $R_1$ and $R_2$ such as those derived from alpha-olefins which have been isomerised to redistribute the double bond, can be used. Sultones for use in compositions of this invention can be prepared as described in British Pat. Nos. 991,819, 1,030,648 and 1,072,166, Canadian Pat. No. 894,830 and U.S. Pat. No. 3,524,864.

The purpose of the dispersing agent in the composition is primarily to enable dispersion in aqueous media of the insoluble sultone in fine particles or droplets so that the resulting aqueous compositions can be used to contact multiple fibre materials and confer softening properties. Hence any dispersing agent that enables an aqueous sultone dispersion to be formed can be used. Preferably the dispersing agent is a detergent-active compound, so that the composition can also act as a detergent composition, for instance in washing soiled fabrics and imparting a soft feel to them.

Detergent-active compounds can be anionic, nonionic, cationic, amphoteric or zwitterionic in character, but preferably the detergent-active compound comprises an anionic detergent-active compound. Typical anionic detergent-active compounds are water-soluble or water-dispersible alkali metal salts of organic acids, especially sodium and potassium salts, and the corresponding ammonium and substituted ammonium salts. Examples of suitable organic acids are alkylbenzene sulphonic acids whose alkyl groups contain from 8 to 20 carbon atoms, for instance linear $C_{10}$-$C_{15}$ alkylbenzene sulphonic acids; alkyl and alkenyl sulphonic acids of from 8 to 22 carbon atoms, for instance those referred to herein as olefin sulphonates which can be derived by reaction of sulphur trioxide with linear and branched olefins, especially "cracked wax" or "Ziegler" alpha-olefins, or those derived by reaction of alkanes with sulphur dioxide and chlorine and subsequent hydrolysis, or by reaction of olefins with bisulphites; alkyl sulphosuccinates derived by reacting maleic acid esters with bisulphites; alkyl sulphuric acids of from 8 to 22 carbon atoms obtained by reaction of alcohols and sulphur trioxide; alkylether sulphuric acids obtained by reaction of molar quantities of alcohols of from 6 to 18 carbon atoms with 1 to 15 mols of ethylene oxide or mixtures of ethylene oxide and propylene oxide, and subsequently reacting the condensation product with sulphur trioxide; and natural or synthetic aliphatic carboxylic acids of from 10 to 22 carbon atoms, especially the soaps obtained by splitting of triglyceride oils.

Examples of suitable nonionic detergent-active compounds are condensates of linear and branched-chain aliphatic alcohols or carboxylic acids of from 8 to 18 carbon atoms with ethylene oxide, for instance a coconut alcohol — ethylene oxide condensate of 6 to 30 mols of ethylene oxide per mol of coconut alcohol; condensates of alkylphenols whose alkyl group contains from 6 to 12 carbon atoms with 5 to 25 mols of ethylene oxide per mol of alkylphenol; condensates of the reaction product of ethylenediamine and propylene oxide with ethylene oxide, the condensates containing from 40 to 80% of polyoxyethylene radicals by weight and having a molecular weight of from 5,000 to 11,000; tertiary amine oxides of structure $R_3NO$, where one group R is an alkyl group of 8 to 18 carbon atoms and the others are each methyl, ethyl or hydroxyethyl groups, for instance dimethyldodecylamine oxide; tertiary phosphine oxides of structure $R_3PO$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2SO$ where one group R is an alkyl group of from 10 to 18 carbon atoms and the other is methyl or ethyl, for instance methyltetradecyl sulphoxide.

Suitable cationic detergent-active compounds are quaternary ammonium salts having an aliphatic radical of from 8 to 18 carbon atoms, for instance cetyltrimethylammonium bromide.

Examples of suitable amphoteric detergent-active compounds are derivatives of aliphatic secondary and tertiary amines containing an alkyl group of 8 to 18 carbon atoms and an aliphatic radical substituted by an anionic watersolubilising group, for instance sodium 3-dodecylaminopropionate, sodium 3-dodecylaminopropane sulphonate and sodium N-2-hydroxydodecyl-N-methyltaurate.

Suitable zwitterionic detergent-active compounds are derivatives of aliphatic quaternary ammonium, sulphonium and phosphonium compounds having an aliphatic radical of from 8 to 18 carbon atoms and an aliphatic radical substituted by an anionic water-solubilising group, for instance 3-(N,N-dimethyl-N-hexadecylammonium)propane-1-sulphonate betaine, 3-(dodecylmethylsulphonium)propane-1-sulphonate betaine and 3-(cetylmethylphosphonium)ethane sulphonate betaine.

Dispersing agents that can be used include surface-active agents that are not regarded as detergent-active compounds, for example a water-soluble polyethylene glycol of molecular weight 200.

Further examples of dispersing agents are compounds commonly used as surface-active agents given in the wellknown textbooks "Surface Active Agents", Volume I by Schwarz and Perry and "Surface Active Agents and Detergents", Volume II by Schwartz, Perry and Berch.

Preferably when the dispersing agent comprises an anionic detergent-active compound, at least a major proportion of it is an alpha-olefin sulphonate, as it is then possible to prepare the sultone softening agent and the dispersing agent together in one process and to avoid the need to isolate the sultone.

Where the dispersing agent comprises an olefin sulphonate, and preferably also where it is any other detergent-active compound, a detergency builder is also present. By detergency builder is meant a substance that itself has no more than weak detergent properties, but possesses the power of increasing the detergent activity of a detergent-active compound.

Suitable detergency builders are inorganic builders such as sodium ortho-, pyro-, trimeta- and tripolyphosphates, sodium carbonate and sodium silicate. Examples of organic builders are salts of organic acids such as sodium citrate, sodium oxydiacetate, sodium carboxymethyloxysuccinate, sodium nitrilotriacetate, sodium ethylenediamine tetraacetate, sodium salts of $C_{10}$-$C_{20}$ alkyl-substituted malonic and succinic acids, sodium salts of resin acids derived from the polymerisation of unsaturated carboxylic acids or anhydrides, for instance acrylic, methacrylic, crotonic, maleic, itaconic and aconitic acids and their anhydrides, or from their copolymerisation with minor amounts of other monomers, for instance vinyl chloride, vinyl acetate, methyl acrylate, methyl methacrylate and styrene; and starches modified by oxidation with sodium hypochlorite with opening of anhydroglucose units to give dicarboxylic acid units.

Compositions of the invention can contain other fabricwashing detergent composition ingredients, for instance lather boosters, such as coconut monoethanolamide; lather controllers; inorganic salts such as sodium and magnesium sulphates; sodium perborate; chlorine-releasing bleaching agents for instance trichloroisocyanuric acid and sodium and potassium dichloroisocyanurates; antiredeposition agents, such as sodium carboxymethylcellulose; and perfumes, colourants, fluorescers, corrosion inhibitors, germicides and proteolytic enzymes.

A composition of the invention can contain from 0.01 to 500 parts of sultone to 1 part by weight of dispersing agent, and can consist wholly of sultone and dispersing agent. Where the dispersing agent comprises an olefin sulphonate, and preferably also where it does not, a fabric-softening composition of the invention contains at least 0.2 parts of sultone to 1 part by weight of dispersing agent. From 0.2 to 200 parts, preferably 0.2 to 40, and especially 0.25 to 4 parts of sultone to 1 part of dispersing agent are convenient, particularly when the dispersing agent is a detergent-active compound and the product is to be employed for its detergent as well as its softening properties, for then a desirable balance of softening and detergent action can be provided without waste of detergent power. Preferably also from 1 to 20 parts of detergency builder to 1 part by weight of detergent-active compound are present. Preferably the composition is provided as a concentrate containing from 2 to 30% by weight of the sultone, with the remainder dispersing agent, detergency builder, other detergent additive, water and/or diluent. The concentrate can be in the form of a free-flowing powder, for instance one that has been prepared by spray-drying a slurry containing those components that are stable to spray-drying. As gamma-sultones are hydrolysed on spray-drying at the usual temperatures, such as 300° C, these, like other unstable components, should be incorporated afterwards. The concentrates can also be produced by conventional manufacturing techniques as flakes, granules, noodles, cakes, and bars. They can also be produced as liquid concentrates, for instance liquid aqueous dispersions.

To prepare a wash liquor suitable for direct use, the concentrate is simply dispersed in water to give an effective concentration of the softening agent. While the concentration for effectiveness is not a critical one because it has been found that the sultones are deposited at a rate that is diffusion-controlled, it is convenient to use aqueous dispersions containing from 0.005 to 0.5% by weight of the sultone and at least 95% by weight of water. Preferably the aqueous dispersion contains from 0.01 to 0.05% by weight of sultone; it preferably also contains from 0.01 to 0.5% by weight of detergent-active compound. The invention also includes these aqueous dispersions.

The invention also includes a process for the treatment of a material composed of multiple fibres, comprising contacting the material with an aqueous dispersion of a sultone as defined above, the dispersion containing from 0.005 to 0.5% by weight of sultone; with the proviso that where an olefin sulphonate is present at least 0.2 parts of the sultone to 1 part of the olefin sulphonate by weight are present. The aqueous dispersion will in practice contain a dispersing agent which can be a detergent active compound with or without a detergency builder and other ingredients in amounts and relative proportions as described above. Thus the process can be a rinsing process independent of or subsequent to a deterging process, or it can be a deterging process in which softening properties are conferred on the treated fibres. It has been found that when the process is used for washing soiled fabrics softening properties can be conferred without unacceptable loss of detergency efficiency.

The material composed of multiple fibres can be a textile fabric, for instance one made with natural fibres, especially cellulose fibres, for example cotton, and protein fibres, for example wool, modified natural fibres, for example rayon and cellulose triacetate, and synthetic fibres, for example nylon, terephthalic ester fibre and acrylic fibre. The process can also be used for rinsing or washing unwoven fibres, for instance hair.

The weight ratio of sultone present in the aqueous dispersion to fibre used in the process will depend on the amount of sultone it is desired to deposit, and the temperature and duration of the contacting process. The amount of sultone deposited in a given time is a function of the concentration employed, and the deposit is cumulative over a number of wash cycles.

The invention also provides a textile fabric whose fibres have a surface coating of a sultone as defined above, where the amount of sultone present is from 0.1 to 15 parts per 1,000 parts of fibre by weight. A good softening effect is provided by amounts within the range of from 0.4 to 5 parts of sultone per 1,000 parts of fibre by weight. At relatively high concentrations of sultone the desirable phenomenon known as scroop (also known as loftiness, fluffiness) can often be observed. The amounts of sultone on a fabric can be determined by conventional analysis, for instance by solvent extraction and thin-layer chromatography, or by quantitative X-ray fluoroscence analysis.

The invention is illustrated by the following Examples, in which all amounts are by weight, and temperatures are in ° C.

EXAMPLES 1 to 4

Octadec-1-ene was sulphonated in a falling film reactor with sulphur trioxide vapour in air at 60°–80°, the film of olefin being maintained at 25°, and using a total amount of sulphur trioxide slightly in excess of equimolar amounts of sulphur trioxide and olefin. The product of reaction was stored at ambient temperature for 4 weeks to allow isomerisation and then neutralised with caustic soda to pH 9, giving a heterogeneous mixture with solid material in suspension. An equal quantity of isopropanol was added and the mixture extracted with light petroleum, the separated layer of extract washed with aqueous isopropanol, evaporated and the residue crystallised from isopropanol as colourless crystalline flakes of sultone. By infrared spectroscopy it was established that it contained 10% gamma and 90% delta n-octadecane sultones.

Liquid concentrate compositions containing this sultone and an olefin sulphonate were prepared and tested for their fabric-softening properties in comparison with a standard detergent composition A and a detergent composition B containing a sodium fatty acid sulphonate known to be an effective softener. The compositions were prepared by admixture of ingredients in the amounts shown in the following table.

| Example or Composition No. | 1 | 2 | 3 | 4 | A | B |
|---|---|---|---|---|---|---|
| Sodium $C_{14}$-$C_{16}$ alpha-olefin sulphonate | 10 | 10 | 10 | 10 | | |
| A commercially-available sodium $C_{11}$-$C_5$ alkylbenzene sulphonate | | | | | 10 | 10 |
| Sodium fatty acid sulphonate derived from hardened tallow fatty acid | | | | | | 25 |
| n-Octadecane sultone | 5 | 10 | 15 | 20 | | |
| Sodium tripolyphosphate | 50 | 50 | 50 | 50 | 50 | 25 |
| Anhydrous alkaline sodium silicate ($Na_2O$:$SiO_2$ ratio 1:2) | 10 | 10 | 10 | 10 | 10 | 10 |
| Sodium sulphate | 10 | 10 | 10 | 10 | 10 | 10 |
| Sodium carboxymethylcellulose | 1 | 1 | 1 | 1 | 1 | 1 |
| Water | 114 | 109 | 104 | 99 | 119 | 119 |
| Parts of sultone per part of detergent-active compound | 0.5 | 1 | 1.5 | 2 | 0 | 0 |

Each composition was dispersed in water of 18° hardness and a Ca:Mg ratio of 2:1 to give an aqueous dispersion containing 0.3% of the composition and the aqueous dispersion used to wash fabric consisting of a standard number of cotton towelling pieces by contacting them in a Terg-O-Tometer with 20 times their weight of the aqueous dispersion at 55° for 15 minutes, followed by rinsing and drying. The towelling pieces were then assessed for relative softness by a panel of 5 persons, being arranged and ranked in groups of 4 according to a statistical design enabling all the tested compositions to be compared and giving a total score result for each composition. The total scores obtained were as follows, a lower score indicating a greater softening effect.

| Composition | 1 | 2 | 3 | 4 | A | B |
|---|---|---|---|---|---|---|
| Softening score | 218 | 156 | 184 | 190 | 278 | 228 |

These results indicate that the compositions of Examples 1 to 4 gave a strong fabric-softening effect in comparison with the standard detergent composition A, and an effect at lower concentrations of softener superior to that of the detergent composition B containing the known sodium fatty acid sulphonate softener.

EXAMPLES 5 and 6

Liquid concentrate compositions were prepared by admixture of the following ingredients, the octadecane sultone being the 10% gamma-90% delta mixture of Examples 1 to 4.

| Example No. | 5 | 6 |
|---|---|---|
| Sodium $C_{18}$ alpha-olefin sulphonate | 7.5 | |
| Sodium dodecylbenzene sulphonate | | 15 |
| n-Octadecane sultone | 7.5 | 10 |
| Sodium tripolyphosphate | 50 | 50 |
| Anhydrous alkaline sodium silicate ($Na_2O$:$SiO_2$ ratio 1:2) | 10 | 10 |
| Sodium carboxymethylcellulose | 1 | 1 |
| Sodium sulphate | 10 | 10 |
| Water | 114 | 104 |
| Parts of sultone per part of detergent-active compound | 1 | 0.67 |

Aqueous dispersions containing 0.3% by weight of these compositions were used to wash cotton towelling pieces and softness assessed as described in Examples 1 to 4. In both instances softening scores were obtained that were lower than those with controls in which wash liquors without the sultone were used.

EXAMPLES 7 to 13

Liquid concentrate compositions were prepared by admixture of the following ingredients, the octadecane sultone being that of Examples 1 to 4, and the hexadecane sultone being one prepared from hexadec-1-ene by a process similar to that described in Examples 1 to 4 and consisting of a mixture of 10% gamma and 90% delta n-hexadecane sultones.

Aqueous dispersions containing 1.2% of these compositions were prepared using water of 30° hardness and a Ca:Mg ratio of 10:1, and used to wash cotton towelling pieces as described in Examples 1 to 4 except that washing was carried out at 95° for 30 minutes, and the fabric assessed for softness as before.

| Example No. | 7 | 8 | 9 | 10 | 11 | 12 | 13 |
|---|---|---|---|---|---|---|---|
| Sodium $C_{18}$ alpha-olefin sulphonate | 3.5 | — | — | — | — | 7.5 | 5 |
| Sodium $C_{16}$ alpha-olefin sulphonate | — | 5 | — | — | — | — | — |
| Sodium dodecyl benzene sulphonate | — | — | 5 | — | — | — | — |
| Sodium tallow alcohol sulphate | — | — | — | 5 | — | — | — |
| Nonylphenol (10 ethylene oxide) condensate | — | — | — | — | 5 | — | — |
| n-Octadecane sultone | 3.5 | 5 | 5 | 5 | 5 | 2.5 | — |
| n-Hexadecane sultone | — | — | — | — | — | — | 5 |
| Sodium tripolyphosphate | 35 | 35 | 35 | 35 | 35 | 35 | 35 |
| Anhydrous alkaline sodium silicate ($Na_2O$:$SiO_2$ ratio 1:2) | 9 | 9 | 9 | 9 | 9 | 9 | 9 |
| Sodium perborate | 20 | 20 | 20 | 20 | 20 | 20 | 20 |
| Sodium carboxymethylcellulose | 0.5 | 0.5 | 0.5 | 0.5 | 0.5 | 0.5 | 0.5 |
| Sodium sulphate | 6 | 6 | 6 | 6 | 6 | 6 | 6 |
| Water | 122.5 | 119.5 | 119.5 | 119.5 | 119.5 | 119.5 | 119.5 |
| Parts of sultone per part of | | | | | | | |

-continued

| Example No. | 7 | 8 | 9 | 10 | 11 | 12 | 13 |
|---|---|---|---|---|---|---|---|
| detergent-active compound | 1 | 1 | 1 | 1 | 1 | 0.33 | 1 |

In every case softening scores were obtained lower than those with controls in which wash liquors without the sultone were used.

EXAMPLES 14 to 19

Liquid concentrate compositions were prepared by admixture of the ingredients given below. The sultone used was the pure delta-sultone derived from octadec-1-ene.

| | Control | Example No. | | | | | |
|---|---|---|---|---|---|---|---|
| | | 14 | 15 | 16 | 17 | 18 | 19 |
| Delta-n-octadecane sultone | 0 | 1 | 2 | 3 | 4 | 5 | 6 |
| Sodium dodecylbenzene sulphonate | | | | 5 | | | |
| Sodium tripolyphosphate | | | | 35 | | | |
| Anhydrous alkaline sodium silicate ($Na_2O:SiO_2$ ratio 1:2) | | | | 9 | | | |
| Sodium sulphate | | | | 6 | | | |
| Sodium carboxymethylcellulose | | | | 0.5 | | | |
| Water | 144.5 | 143.5 | 142.5 | 141.5 | 140.5 | 139.5 | 138.5 |

The compositions were dispersed in water at 1.2% concentration and the aqueous dispersion then used to wash cotton fabric pieces as described in Examples 7 to 13, except that washing was carried out for 15 minutes, and then rinsed and dried, with assessment by a panel as before.

In order to determine the approximate amounts of sultone present on the treated fabric, 2 square inch portions of each piece of fabric were analysed for calcium and sulphur content by quantitiative X-ray fluroescence analysis. The sultone present was calculated from the sulphur content determined, after correction for the amount of sulphur representing the calcium salt of the dodecylbenzene sulphonic acid deposited in the hard water from the detergent active salt. The amounts were averaged to give the levels of sultones on the fabric for each formulation. The results obtained were as follows:

| | Control | Example No. | | | | | |
|---|---|---|---|---|---|---|---|
| | | 14 | 15 | 16 | 17 | 18 | 19 |
| Softening score | 271 | 247 | 224 | 191 | 146 | 149 | 142 |
| Sultone present in parts per thousand of fabric | — | 0.17 | 0.5 | 0.82 | 1.03 | 1.1 | 1.47 |

Although the softening score had dropped off at the highest concentration, the treated fabric pieces exhibited the property of scroop.

EXAMPLES 20 to 26

In these Examples the softening properties of a series of sultones were tested, the sultones being as follows:

| Example No. | 20 | 21 | 22 | 23 | 24 | 25 | 26 |
|---|---|---|---|---|---|---|---|
| Sultone | | | | | | | |
| n-Tetradecane | gamma | delta | | | | | |
| n-Hexadecane | | | gamma | | | | |
| n-Octadecane | | | | gamma | delta | | |
| n-Docosane | | | | | | gamma | 20% gamma, 80% delta |

The sultones were the pure compounds derived by sulphur trioxide reaction with straight chain alpha-olefins, except that the delta-docosane sultone was a mixture mostly in the delta form and obtained by the sulphonation of docos-1-ene dissolved in light petroleum (b.p. 60°–80°) with sulphur trioxide vapour and nitrogen at 50° using a 20% molar excess sulphur trioxide for 1 hour and allowing the reaction mixture to age for 4 hours at 60° in order to allow isomerisation to delta-sultone, followed by filtration and recrystallisation of the sultone residue from methanol and finally from hexane.

Aqueous dispersions of each sultone were prepared by dispersing by vigorous stirring using a Silverson mixer of 0.04% by weight of sultone in a 0.02% by weight aqueous solution of a non-ionic detergent-active compound prepared by the condensation of 7 mols ethylene oxide with 1 mol of a $C_{15}$ linear primary alcohol, and a number of cotton towelling pieces rinsed in each solution at ambient temperature for 2 minutes in a Terg-O-Tometer. The rinsed fabric pieces were dried and submitted to a panel for assessment of their softening properties in comparison with the same fabric treated with a solution of the non-ionic detergent containing no sultone as control. In every instance the sultone-treated fabric was softer than the control.

EXAMPLES 27 to 34

Liquid concentrate softening compositions containing a series of sultones were prepared by admixture of the following ingredients.

| | |
|---|---|
| Sodium dodecylbenzene sulphonate | 5 |
| Sodium tripolyphosphate | 35 |
| Anhydrous alkaline sodium silicate ($Na_2O:SiO_2$ ratio 1:2) | 10 |
| Sodium sulphate | 10 |
| Sodium carboxymethylcellulose | 0.5 |
| Sodium perborate | 20 |
| Water | 114.5 |
| Sultone | 5 |

The sultones were as given in the table below.

From the liquid concentrates were prepared aqueous dispersions containing 1.2% of concentrate using water of 30° hardness and a Ca:Mg ratio of 10:1, and the dispersions used to wash cotton towelling pieces as described in Examples 1 to 4, except that washing was carried out at 95° C for 30 minutes and the fabric assessed for softness as before and analysed for sultone content as described in Examples 14 to 19.

| Sultone | | Example No. | Softening score | Sultone present (parts per 1000 of fabric) |
|---|---|---|---|---|
| n-Tetradecane | gamma | 27 | 248 | 0.92 |
| | delta | 28 | 237 | 1.65 |
| n-Octadecane | gamma | 29 | 130 | 1.95 |
| | delta | 30 | 185 | 0.73 |
| n-Dodocosane | gamma | 31 | 187 | 0.95 |
| | {20% gamma, 80% delta} | 32 | 147 | 0.91 |
| None | | — | 266 | — |

A series of delta-sultones were incorporated in liquid concentrate softening compositions and aqueous dispersions whose other ingredients were the same as those of Examples 27 to 32, and the aqueous dispersions used to wash cotton towelling pieces as before and the softness of the washed pieces assessed with results as follows.

| Delta-sultone | Example No. | Softening score |
|---|---|---|
| n-Tetradecane | 28 | 215 |
| n-Hexadecane | 33 | 189 |
| n-Octadecane | 30 | 172 |
| n-Eicosane | 34 | 174 |
| n-Docosane (including 20% gamma) | 32 | 159 |
| None | — | 263 |

EXAMPLE 35

In this Example a reaction product of sulphur trioxide and alpha-olefin is employed to provide both part of the detergent-active compound and the sultone in a fabric-softening composition.

Octadec-1-ene was sulphonated with sulphur trioxide as described in Examples 1 to 4, but instead of isolating the sultone by solvent extraction, the whole product from neutralisation with caustic soda was employed. It was formulated with detergency builder and other ingredients to give a slurry which was spray-dried in air at 300°–350° and sodium perborate powder afterwards added to provide a free-flowing powder composition having the following ingredients.

| | |
|---|---|
| Sodium dodecylbenzene sulphonate | 3 |
| Sodium $C_{18}$ alpha-olefin sulphonates | 7 |
| Delta-octadecane sultone | 5 |
| Sodium tripolyphosphate | 36 |
| Anhydrous alkaline sodium silicate ($Na_2O:SiO_2$ ratio 1:2) | 9 |
| Sodium sulphate | 6 |
| Sodium carboxymethylcellulose | 0.5 |
| Fluorescer | 0.5 |
| Water | 13 |
| Sodium perborate | 20 |

The resulting powder was dispersed in water of 30° hardness to give a dilute aqueous dispersion containing 0.6% of the composition and the aqueous dispersion used to wash in a Terg-O-Tometer at 95° for 30 minutes cotton towelling pieces both unsoiled and soiled by standard soiling processes using two different test soils.

The rinsed and dried test pieces were assessed for softness as before and also for detergency efficiency of the process by measuring whiteness in a reflectometer as % reflectance of a calcium oxide standard.

The results are compared with those obtained with a conventional non-soap detergent composition as follows.

| | Softening Scores | Detergency Efficiency | |
|---|---|---|---|
| | | Soil 1 | Soil 2 |
| Sultone softening composition | 97 | 64.4 | 70.6 |
| Conventional detergent | 220 | 63.0 | 72.8 |

These results demonstrate a marked softening effect with no substantial loss of detergency efficiency.

EXAMPLES 36 to 41

Softening compositions were prepared from the following ingredients.

| Example No. | 36 | 37 | 38 | 39 | 40 | 41 |
|---|---|---|---|---|---|---|
| Delta-n-octadecane sultone | 10 | 20 | 25 | 25 | 50 | 90 |
| Sodium salt of sulphated condensate of $C_{12}$ and $C_{14}$ n-alkanol mixture with 12–14 mols ethylene oxide | 15 | | | | | |
| Cetyltrimethylammonium bromide | | 2 | | | | |
| Sodium lauryl sulphate | | | 1 | 1 | 5 | 0.5 |
| Isopropyl alcohol | 75 | 78 | | | | |
| Sodium sulphate | | | 74 | | 45 | 9.5 |
| Sodium carbonate | | | | 74 | | |
| Parts of sultone per part of detergent-active compound | 0.67 | 10 | 25 | 25 | 10 | 180 |

The compositions of Examples 36 and 37 were liquid concentrates prepared by dispersing the detergent-active compound and sultone in isopropyl alcohol. The compositions of Examples 38 to 41 were solid concentrates prepared by mixing the powdered ingredients.

Aqueous dispersions containing amounts of the compositions providing 0.02% of sultone were prepared by dispersing the compositions in water of 24° hardness and a Ca:Mg ratio of 10:1, and used to rinse, at 70° and a liquor to fabric ratio of 20:1, cotton towelling pieces, and the fabric assessed for softness as described in Examples 1 to 4. A control rinse with the water containing no additive was also carried out. The results were as follows.

| Example No. | 36 | 37 | 38 | 39 | 40 | 41 | Control |
|---|---|---|---|---|---|---|---|
| Softening score | 155 | 87 | 239 | 251 | 173 | 181 | 314 |

These results all show the softening effect of the sultone: where the dispersing agent is a cationic detergentactive compound, this also contributes to the softening agent.

EXAMPLES 42 and 43

A softening composition was prepared by dispersing 5 parts of delta-n-octadecane sultone in a solution of 5 parts of sodium dodecylbenzene sulphonate in 90 parts of water. The resulting liquid concentrate was dispersed in water of 24° hardness and a Ca:Mg ratio of 10:1 to give an aqueous dispersion containing 0.03% of sultone. This dispersion was used to rinse, at 50° and a liquor to fabric ratio of 20:1, pieces of bulked acrylic fabric and bulked nylon fabric which had previously been washed with a detergent solution and dried, and the fabrics assessed for softness. A control rinse with the water containing no additive was also carried out. The results were as follows.

| | Example No. | Softening score | Control Softening score |
|---|---|---|---|
| Acrylic fabric | 42 | 40 | 60 |
| Nylon fabric | 43 | 30 | 70 |

These results demonstrate the softening effect of the sultone.

What is claimed is:

1. A fabric-softening composition comprising a dispersing agent and a sultone of from 14 to 30 carbon atoms of the structure

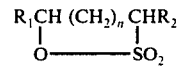

in which each of $R_1$ and $R_2$ is H or an aliphatic hydrocarbon radical having a chain of from 1 to 27 carbon atoms, at least one of $R_1$ and $R_2$ has a chain of at least 10 carbon atoms, and *n* is 1 or 2, containing from 2 to 30% by weight of sultone and from 0.2 to 200 parts of sultone being present to 1 part by weight of dispersing agent; where the dispersing agent includes a detergent-active compound comprising an olefin sulfonate, the composition contains 1–20 parts of detergency builder per 1 part by weight of the detergent-active compound.

2. A composition according to claim 1, wherein the sultone has an unbranched saturated hydrocarbon chain of from 16 to 22 carbon atoms and $R_2$ is H.

3. A composition according to claim 2, where the sultone has from 18 to 20 carbon atoms.

4. A composition according to claim 2, where the dispersing agent is a detergent-active compound, and the composition contains from 1 to 20 parts of detergency builder to 1 part by weight of detergent-active compound.

5. A composition according to claim 4, where the detergent-active compound is an anionic detergent-active compound.

6. A composition according to claim 2, in the form of a free flowing powder and from 0.25 to 4 parts of said sultone being present per part by weight of dispersing agent.

7. A composition according to claim 4, in the form of a free flowing powder and from 0.25 to 4 parts of said sultone being present per part by weight of detergent-active compound.

8. A composition according to claim 2, in the form of a liquid aqueous dispersion containing from 0.01 to 0.5% by weight of the sultone and at least about 95% by weight of water.

9. A composition according to claim 1, in the form of a liquid aqueous dispersion containing from 0.01 to 0.5% by weight of the sultone, from 0.01 to 0.5% by weight of detergent-active compound, and at least about 95% by weight of water.

10. A composition according to claim 4, where at least a major proportion of the detergent-active compound is an alpha-olefin sulphonate.

* * * * *